United States Patent [19]

Hoagg, Jr. et al.

[11] Patent Number: 5,032,847

[45] Date of Patent: Jul. 16, 1991

[54] METHOD FOR FABRICATING ANTENNA REFLECTOR PANELS

[75] Inventors: James W. Hoagg, Jr., Plano; Richard D. Knief, Garland; Thaddeus Kucharski, Richardson, all of Tex.

[73] Assignee: Datron Antennas, Inc., Dallas, Tex.

[21] Appl. No.: 147,735

[22] Filed: Jan. 25, 1988

[51] Int. Cl.[5] ..... H01Q 15/14

[52] U.S. Cl. ..... 343/912

[58] Field of Search ..... 343/840, 878, 912, 915, 343/916

[56] References Cited

U.S. PATENT DOCUMENTS 3,234,550 2/1966 Thomas ..... 343/912

*Primary Examiner*—Akm Ullah
*Assistant Examiner*—Robert E. Wise
*Attorney, Agent, or Firm*—Edward A. Sokolski

[57] ABSTRACT

A pair of reflector "skins" which are typically thin metal sheets of the order of five feet by eight feet are placed side by side on the bed of a fixture, this bed having a predetermined size and a contour which is typically parabolic. Longitudinal rib members having a "Z" cross section and the same contour as the bed are placed in the fixture on top of the sheets in spaced relationship to each other and running along the longitudinal extent of the sheets. These ribs are secured in position by means of clamps which press the ribs securely against the sheets so that the entire surfaces thereof are held in mating engagement with the fixture bed so that they assume the contour thereof. The ends of the "Z" cross section ribs are secured to each other by means of gussets and clips. The runners of the ribs which abut against the sheets have a series of small holes spaced therealong. With the sheets thus tightly held in abutment against the bed of the tray fixture, the sheets and the ribs are welded together by means of welds made at each of the holes in the ribs. The structure is completed by welding stabilizing members laterally between the ribs.

7 Claims, 4 Drawing Sheets

METHOD FOR FABRICATING ANTENNA REFLECTOR PANELS

This invention relates to the fabrication of reflector panels for microwave antenna reflectors and more particularly to such a method in which reflecting sheets are clamped to the bed of a tray having the contour of the panels and a similarly contoured rib structure welded to such sheets to form such panels.

Large microwave antennas such as utilized in communications and radar applications often utilize a relatively large parabolic reflector structure formed from metallic panel sections which are joined together to form the composite reflector structure. Such panel sections are generally made of thin metal sheets which are joined to a support structure formed by a plurality of support struts.

Several considerations are involved in the proper design of such antenna reflectors. First, it is essential that the panels be precisely contoured to provide the desired parabolic configuration which is often employed. Further, particularly in large area structures, the weight of the panels and support structure must be kept to a minimum. Finally, discontinuities in the reflecting surface of the panels must be minimized to avoid the creation of inter-modulation products in the received or transmitted signals. Rivets are often utilized in joining panels to their support structure in prior art antennas. The use of rivets tends to create irregularities in the surfaces of the panels which can cause the aforementioned undesirable intermodulation products.

The method of the present invention enables the fabrication of antenna reflector panel structures which are accurately contoured, have the desired light weight structure, and in which discontinuities in the reflector surface are minimized. These desired end results are achieved by placing the antenna reflector sheets on a parabolically contoured tray bed. A plurality of contoured ribs or struts having a "Z" shaped cross section are clamped against the surface of the sheets to tightly hold the sheet surface in abutment against the surface of the tray bed. In most cases the sheets are flat and when clamped to the bed assume the parabolic contour thereof. Where the sheets are quite wide, it may be necessary to preform them to the desired parabolic contour. The abutting surfaces of the ribs have small holes formed therein and with the ribs clamped in position against the sheets, so that both the ribs and the sheets conform with the contour of the tray bed, welds are employed to join the ribs to the rear surfaces of the reflector sheets. Cross struts are then welded to the ribs to provide structural reinforcement therefor.

It is therefore an object of this invention to provide an improved method for fabricating microwave antenna reflector panels.

It is a further object of this invention to provide a method for fabricating microwave antenna reflector panels which are accurately contoured and have minimum discontinuity in their reflector surfaces.

Other objects of the invention will become apparent as the description proceeds in connection with the accompanying drawings of which:

Figure 1:
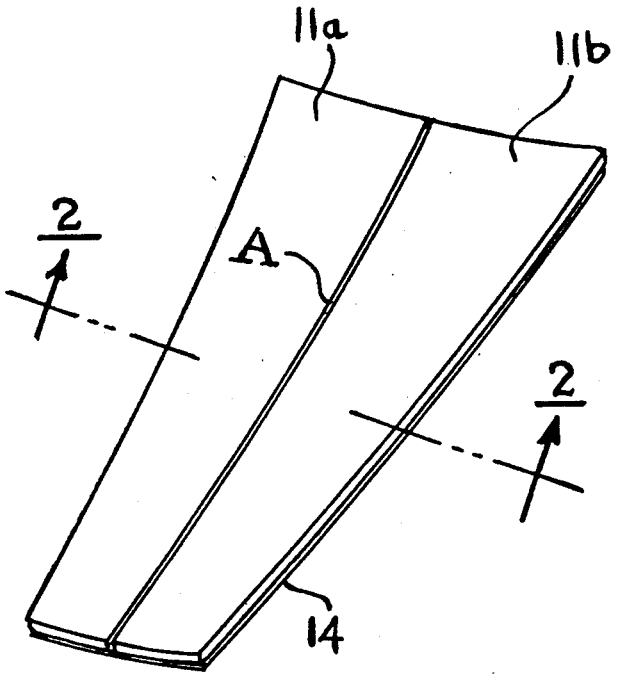
FIG. 1 is a front perspective view of a panel produced by the method of the invention.
Figure 2A:
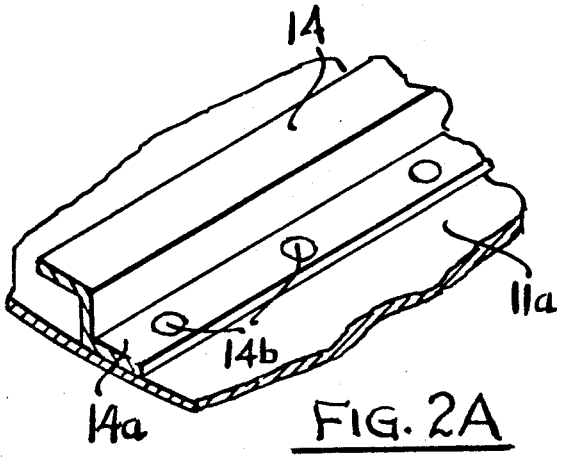
FIG. 2A is a perspective view showing a portion of the rib structure employed in the device fabricated by the method of the invention.
Figure 2:
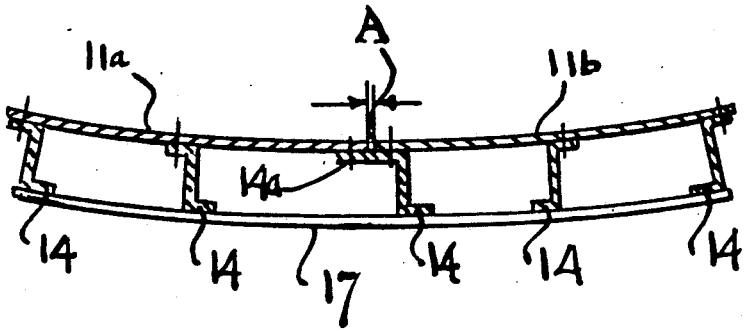
FIG. 2 is a cross sectional view taken along the plane indicated by 2—2 in FIG. 1.
Figure 3:
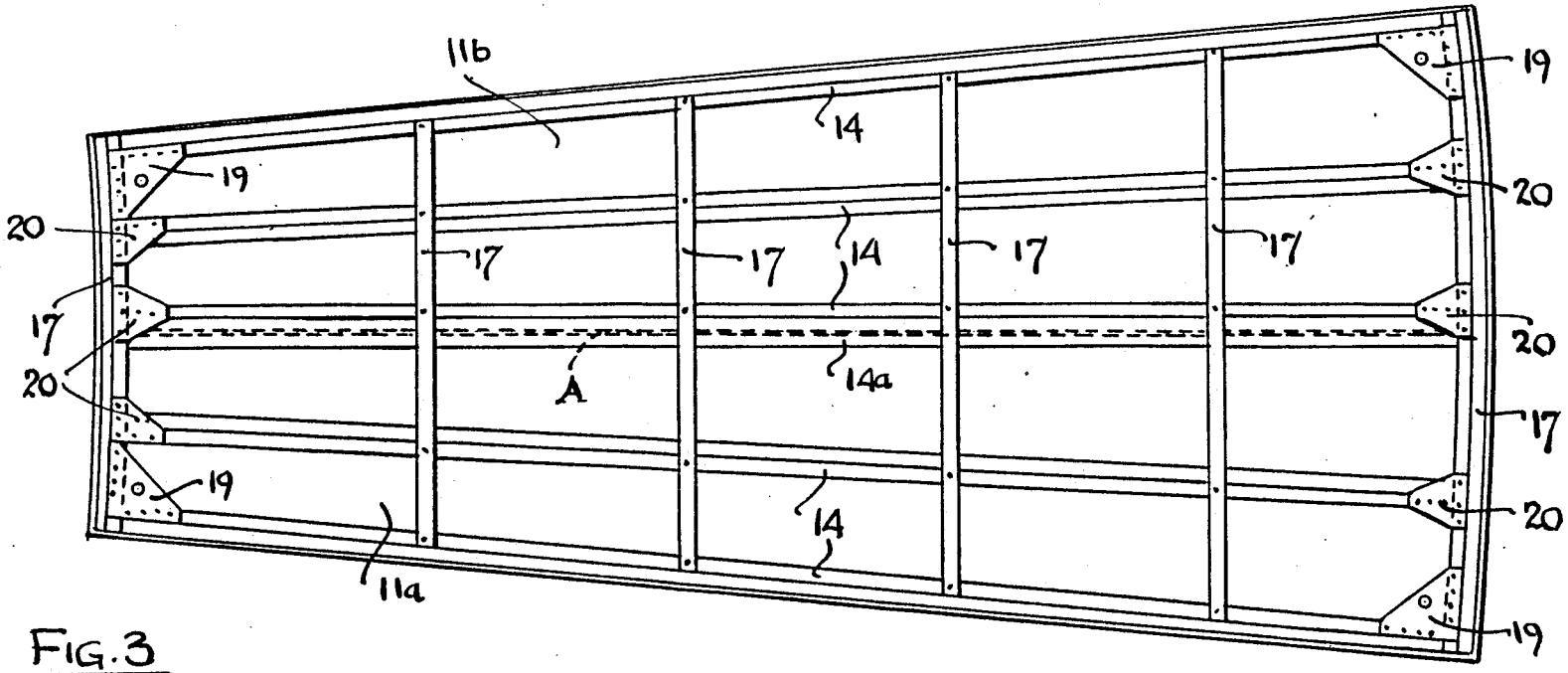
FIG. 3 is a back plan view of a panel structure fabricated by the method of the invention.
Figure 3B:
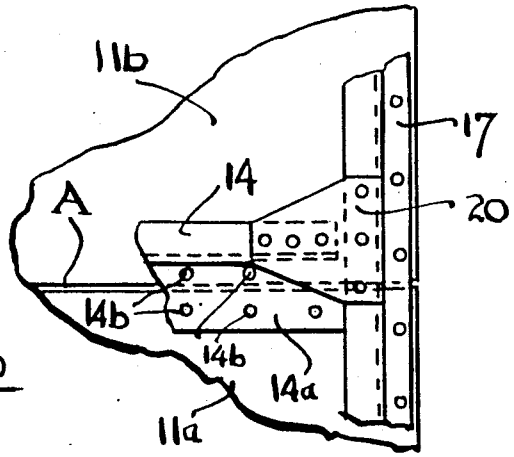
FIG. 3A and 3B illustrate gusset and clip members employed in fabricating the panel structure by the method of the invention.
Figure 3A:
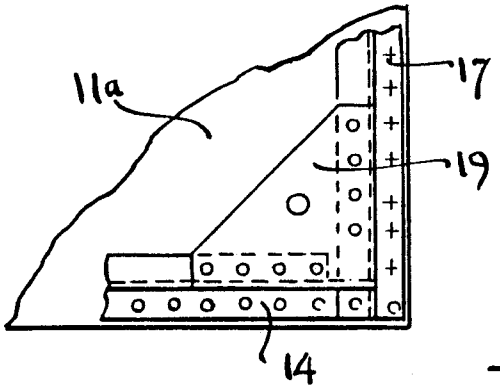
Figure 4A:
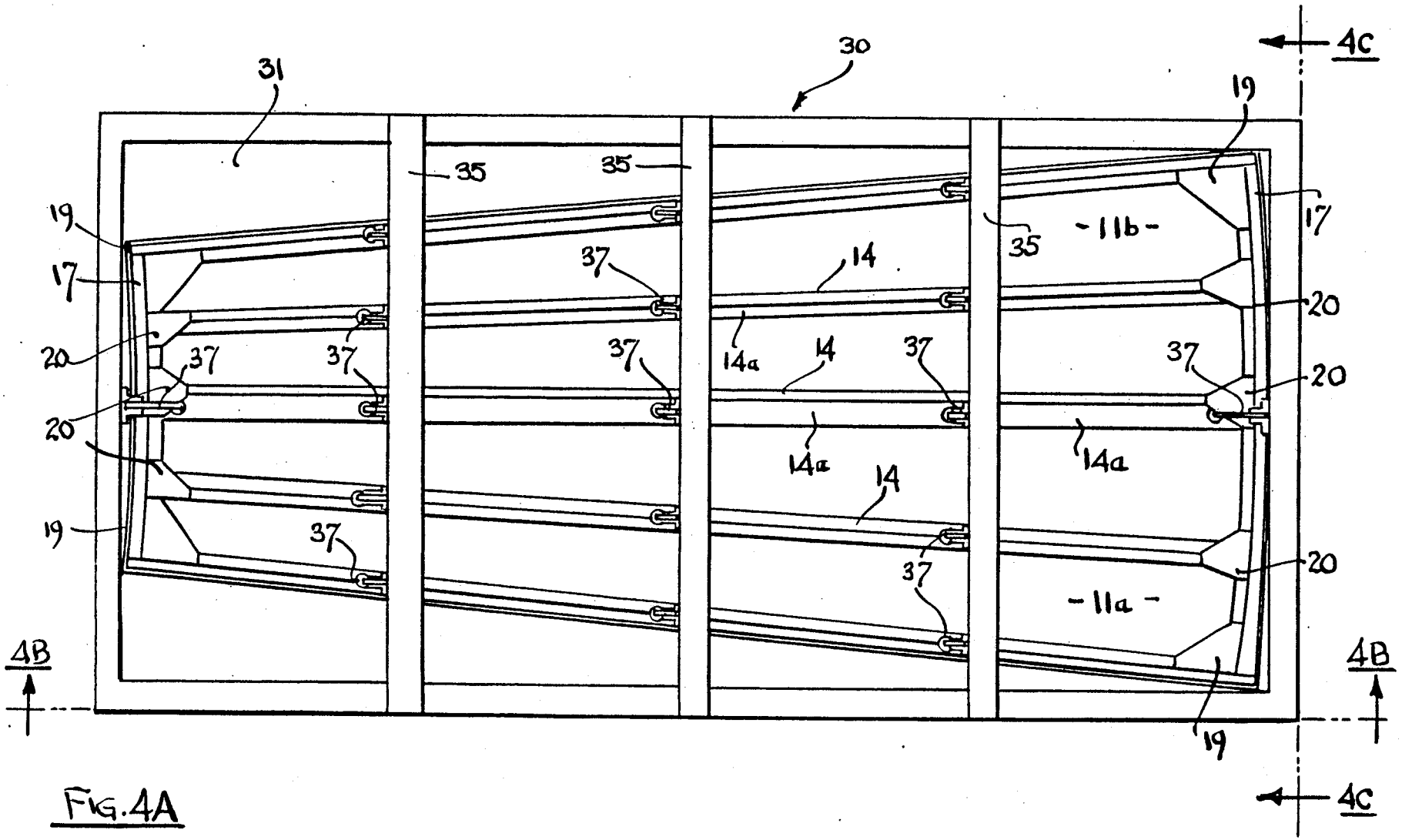
FIG. 4A is a top plan view illustrating the clamping of the panel sheets and rib structure in a jig in carrying out the method of the invention.
Figure 4B:
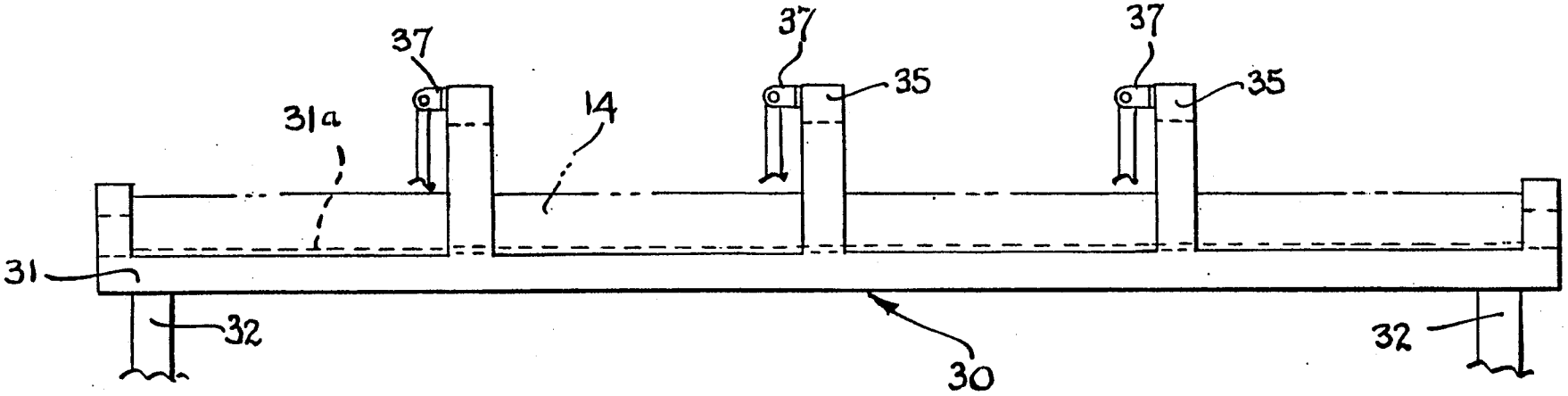
FIG. 4B is a view taken along the plane indicated by 4B—4B in FIG. 4A.
Figure 4C:
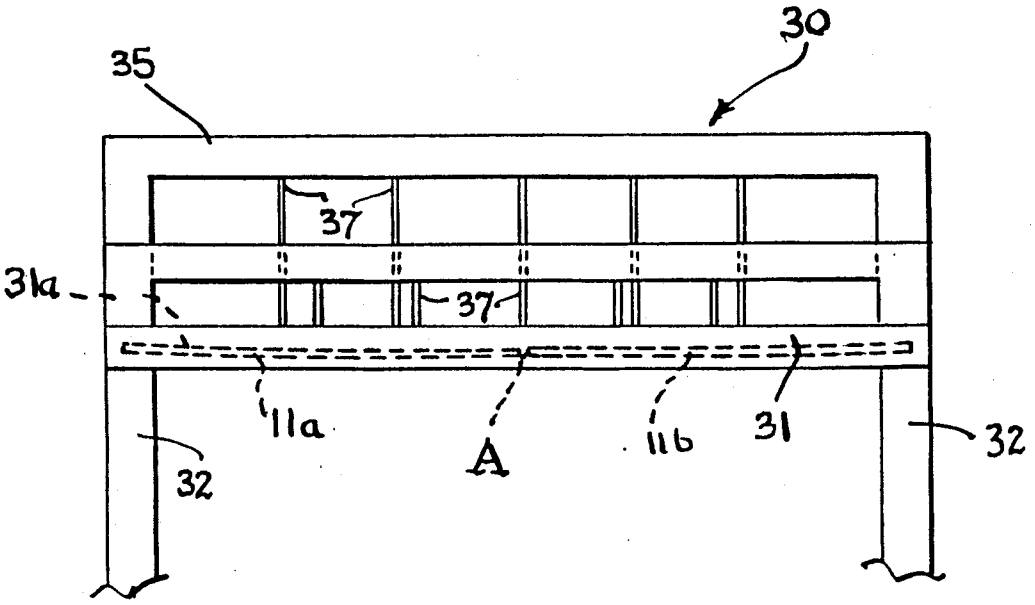
FIG. 4C is a view taken along the plane indicated by 4C—4C in FIG. 4A.

Referring now to FIGS. 1, 2, 2A, 3, 3A and 3B a panel structure fabricated by the method of the invention is iillustrated. Such panel structure is formed from a pair of similar sheets 11*a* and 11*b* may be of 1/16th inch aluminum, the upper surfaces of which (shown in FIG. 1) have a parabolic contour, the panels thus having a truncated conical shape. Welded to the rear surfaces of the panels as best can be seen in FIGS. 2, 2A and 3 are a plurality of rib members 14 which have a "Z" shaped cross section. The bottom leg 14*a* of each "Z" has a plurality of holes 14*b* formed therein through which weld joints are made between the rib members and the panel sheets. Typically, the panel sheets 11*a* and 11*b* are about 2½ feet wide at their top edges, 1½ feet wide at their bottom edges and 8 feet long. Also typically, the holes 14*b* in the ribs have a ¼ inch diameter and are spaced two inches apart. The gap "A" between the two panels is typically 0.04 inches, there being a rib member 14 having a wider base leg 14*a* to accommodate the two panels. Cross struts 17 are welded to ribs 14 to provide reinforcement therefor. Further reinforcement is provided to the opposite ends of the rib structure by means of gussets 19 and clips 20 which are welded to the ribs 14 and cross braces 17. It is to be noted that ribs 14 are preformed precisely to the desired parabolic contour prior to assembly. The sheets 11*a* and 11*b* may initially be flat and contoured to the shape of the parabolically contoured tray bed 31*a* when clamped thereagainst or may be pre-contoured to this shape (particularly in the case of wider sheets). Referring now to FIGS. 4A, 4B and 4C, the fabrication of the panels by the method of the invention is illustrated. A fixture 30 is employed. This fixture has a tray 31 supported on stand 32. Tray 31 has a bed portion 31*a* which is dimensioned and contoured precisely to the desired parabolic shape. Cross beams 35 are provided above the tray to support a plurality of clamps 37 which are used to clamp the rib members 14 against the panels 11*a* and 11*b*.

The panel sheets 11*a* and 11*b* are first laid in position on the contoured tray bed 31*a* with a small gap "A" of the order of 0.04 inches therebetween. Rib members 14 are then placed in position along the surfaces of the panel sheets 11*a* and 11*b* and clamped tightly against these surfaces by means of clamp members 37. It is to be noted that rib members 14 are contoured precisely to the contour of the bed 31*a* so that they will readily follow this contour when placed in position. The ends of ribs 14 are joined to each other by means of cross struts 17 which are attached to the ribs by means of small gussets 19 and clips 20. As already noted, the bottom flanges 14*a* of the ribs which abut against the panels have a plurality of small holes 14*b* which may be of the order of ¼ inch in diameter formed therealong, these holes being spaced apart by about two inches.

With the panel sheets and the ribs firmly in position, the ribs are welded to the panel sheets through holes 14*b* by means of a spot welder. An electronically controlled welding machine which automatically feeds a proper amount of welding wire for a controlled time and at a controlled power setting should preferably be employed to assure that the welds are identical without burn through or cold joints. Finally, cross members 17 which may be spaced about 15 inches apart are welded to ribs 14 to provide stabilization therefor.

While the invention has been described and illustrated in detail, it is clearly to be understood that this is intended by way of illustration and example only and is not to be taken by way of limitation, the spirit and scope of the invention being limited only by the terms of the following claims.

We claim:

1. A method for fabricating an antenna reflector structure comprising the steps of:

placing a pair of panel sheets on a tray bed having a predetermined contour, placing a plurality of longitudinal rib members having a "Z" cross section in spaced relationship on said panel sheets, said rib members having said predetermined contour, clamping said rib members against said panel sheets so that said rib members abut against the panel sheets along the entire longitudinal extent of said rib members and the panel sheets assume the contour of the tray bed, said rib members having a plurality of spaced holes formed therein along the portion thereof which abuts against said panel sheets, and welding said rib members to said panel sheets through the holes formed in the rib members.

2. The method of claim 1 and additionally including the step of welding transverse strut members to said rib members, each of said strut members being welded to each of said rib members, said strut members being spaced from each other along the longitudinal extent of said rib members.

3. The method of claim 1 wherein said panel sheets are separated from each other by a predetermined small distance, one of the legs of the "Z" of one of said brackets bridging said space and abutting against both of said panel sheets.

4. The method of claim 1 wherein the welding of said brackets of said sheets through said holes is done with an automatic machine which feeds a predetermined amount of welding wire for a controlled time and at a controlled power setting to assure identical proper welds.

5. The method of claim 1 wherein the panel sheets are initially flat and are formed to the contour of the tray bed when the rib members are clamped.

6. The method of claim 1 wherein the panel sheets are initially contoured to said predetermined contour.

7. The method of claim 1 wherein said predetermined contour is parabolic.

* * * * *